United States Patent [19]

DeBease

[11] Patent Number: 4,896,438

[45] Date of Patent: Jan. 30, 1990

[54] WATER-RESISTANT BOOT FOR ATHLETIC FOOTWEAR

[76] Inventor: Catherine DeBease, 14 N. Park St., Watertown, Mass. 02172

[21] Appl. No.: 238,569

[22] Filed: Aug. 31, 1988

Related U.S. Application Data

[63] Continuation-in-part of Ser. No. 740,383, Oct. 7, 1985, abandoned.

[51] Int. Cl.[4] ..... A43B 3/16

[52] U.S. Cl. ..... 36/7.1 R; 36/7.3; 36/73

[58] Field of Search ..... 36/7.1 R, 7.2, 7.3, 36/7.4, 7.5, 7.6, 7.7, 73, 103

[56] References Cited

U.S. PATENT DOCUMENTS

| | | | |
|---|---|---|---|
| 1,095,834 | 5/1914 | Ferguson | 36/7.3 |
| 2,785,481 | 3/1957 | Joseph | 36/7.3 |
| 3,559,310 | 2/1971 | Kiela | 36/7.3 |
| 3,858,336 | 1/1975 | Brown | 36/7.3 |
| 4,484,398 | 11/1984 | Goodwin | 36/73 |
| 4,538,368 | 9/1985 | Mugford | 36/7.1 R |

FOREIGN PATENT DOCUMENTS

| | | | |
|---|---|---|---|
| 3147202 | 6/1983 | Fed. Rep. of Germany | 36/7.1 R |
| 17660 | 7/1914 | United Kingdom | 36/7.3 |

*Primary Examiner*—Werner H. Schroeder
*Assistant Examiner*—Diana L. Biefeld
*Attorney, Agent, or Firm*—Joseph S. Iandiorio; Brian M. Dingman

[57] ABSTRACT

A water-resistant boot having a thin, flexible, water-resistant shell which has a lower, body portion that closely surrounds and cradles an athletic shoe. The shell further includes an upper, sleeve portion which closely surrounds the ankle of a user. A water-resistant base is attached to the body portion to engage the sole of the athletic shoe. A retainer is disposed about the lower periphery of the body portion of the shell to force the shell against the athletic shoe to firmly grip the shoe to minimize slippage between the boot and the shoe. The boot further includes one or more elements for securing the sleeve portion about the ankle of the user.

16 Claims, 2 Drawing Sheets

WATER-RESISTANT BOOT FOR ATHLETIC FOOTWEAR

RELATED APPLICATIONS

This application is a continuation-in-part of U.S. Ser. No. 06/740,383, filed Oct. 7, 1985, "Waterproof Coverings for Athletic Shoes and Socks" by Catherine DeBease now abandoned.

FIELD OF INVENTION

This invention relates to a water-resistant or waterproof boot for protecting athletic footwear and more particularly to such a boot which firmly grips the footwear to minimize slippage during active use.

BACKGROUND OF INVENTION

Numerous advances have been made in the construction of athletic footwear to maximize comfort, support, and traction for the user. The improvements include use of lighter weight materials and different tread patterns on the soles of athletic shoes.

Inclement weather can adversely affect outdoor activities because most athletic footwear is not designed to be waterproof. Once the footwear becomes wet the likelihood of blisters and other foot problems increases. At the least, the feet become uncomfortable and the user may become chilled.

Conventional waterproof coverings for footwear are designed for walking and tend to be heavy, stiff and bulky. These features make the coverings undesirable to carry even when there is a possibility of inclement weather. Moreover, the extra weight and stiffness adversely affects the user's athletic performance when these conventional coverings are worn.

Presently, the conventional coverings are relatively loose fitting over the footwear and are prone to slippage relative to the footwear. The slippage between the coverage and the footwear adversely affects maneuverability during athletic activities.

Further, the bulky coverings defeat many of the advances which have been made in athletic footwear technology. For example, the bottom of the coverings interferes with the contact of the specially designed tread patterns to the ground.

SUMMARY OF INVENTION

It is therefore an object of this invention to provide an improved water-resistant covering for athletic footwear which minimizes slippage between the covering and the shoe.

It is a further object of this invention to provide a water resistant boot which securely cradles an athletic shoe while minimizing interference with the performance characteristics of the athletic shoe.

Yet another object of this invention is to provide such a boot which can transfer the impression of the sole of the athletic shoe to enhance registration of the shoe's tread pattern with the ground.

This invention results from the realization that a truly effective protective covering for an athletic she can be achieved by a water-resistant boot having a thin, flexible water resistant shell which closely surrounds and cradles the athletic shoe, and a retainer disposed about the lower portion of the shell which forces the shell against the athletic shoe to firmly grip the athletic shoe to minimize slippage between the boot and the shoe. It is a further realization of this invention that the boot can be provided with a base for engaging the sole of the athletic shoe, the base constructed of a deforming material to conform to the tread pattern of the shoe to enhance transfer of the effect of the tread pattern through the deforming material.

This invention may be accomplished by a water-resistant boot which protects an athletic shoe inserted in the boot. The boot includes a thin, flexible water-resistant shell having a lower, body portion for closely surrounding and cradling the athletic shoe and an upper, sleeve portion for surrounding the ankle of a person wearing the shoe. A water-resistant base is attached to the body portion to engage the sole of the athletic shoe. Retainer means is disposed about the lower periphery of the body portion of the shell to force the shell against the athletic shoe to firmly grip the athletic shoe. Slippage between the boot and the shoe is thereby minimized. The boot further includes means for securing the sleeve portion about the ankle of the user. The boot further includes means for securing the sleeve portion about the ankle of the user.

In one embodiment, the retainer means includes elastic material disposed as a band about the lower periphery of the body portion of the shell. The elastic material is disposed on the outer surface of the shell and completely encircles the shell. Alternatively, at least the lower portion of the shell includes elastic material and the retainer means is integral with the lower portion.

The shell is constructed of a water-resistant fabric which blocks the passage of water into the shell but allows water vapor to pass outwardly through the shell. Alternatively, the boot is constructed of a waterproof material such as rubber. The base includes deforming means for conforming to a tread pattern of the athletic shoe to enhance transfer of the effect of the tread pattern through the deforming means. The deforming means includes a plurality of collapsible hollow projections extending outwardly from the base. The projections are arranged in a pattern which is different from the tread pattern of the athletic shoe. The means for securing includes drawstring means proximate to the opening of the shell and strap means, disposed below the drawstring means, for adjustably holding the sleeve portion to the ankle. The sleeve is of sufficient length to completely enclose an ankle sock worn by the person. The shell, the base and the retainer means may be sufficiently flexible to enable the boot to be compactly folded to enhance portability and convenience.

This invention also features a water-resistant boot having a thin, flexible water-resistant shell having a body portion and a sleeve portion, and a water-resistant base attached to the body portion to engage the sole of the athletic shoe. The base includes deforming means for conforming to a tread pattern of the athletic shoe to enhance transfer of the effect of the tread pattern through the deforming material. The boot further includes means for securing the sleeve portion about the ankle of the user to minimize entrance of water through the opening and to enhance holding of the sleeve portion to the ankle.

DISCLOSURE OF PREFERRED EMBODIMENT

Other objects, features and advantages will occur from the following description of a preferred embodiment and the accompanying drawings, in which.

This invention may be accomplished by a water-resistant boot having a thin, flexible water-resistant shell and a water resistant base. The shell has a lower, body portion which closely surrounds and cradles the athletic shoe and an upper, sleeve portion which surrounds an ankle of a person wearing the shoe. A drawstring, strap or other adjustable mechanism secures the sleeve portion about the ankle of the user.

In one construction, a retainer is disposed about the lower periphery of the body portion of the shell to force the shell against the athletic shoe to firmly grip the athletic shoe. Slippage between the boot and the shoe is thereby minimized. Preferably, the base includes one large deforming element or a number of smaller deforming elements which conform to a tread pattern of the athletic shoe to enhance transfer of the effect of the tread pattern through the deforming material.

The term water-resistant is intended to be construed in its broadest meaning and includes substantially water proof materials. A preferred material for the shell is a water resistant fabric, such as Goretex, which blocks the passage of water into the shell but allows water vapor to pass outwardly through the shell. Alternatively, the shell is formed of a rubber material or a rubber coated material and is fully waterproof.

Figure 1:
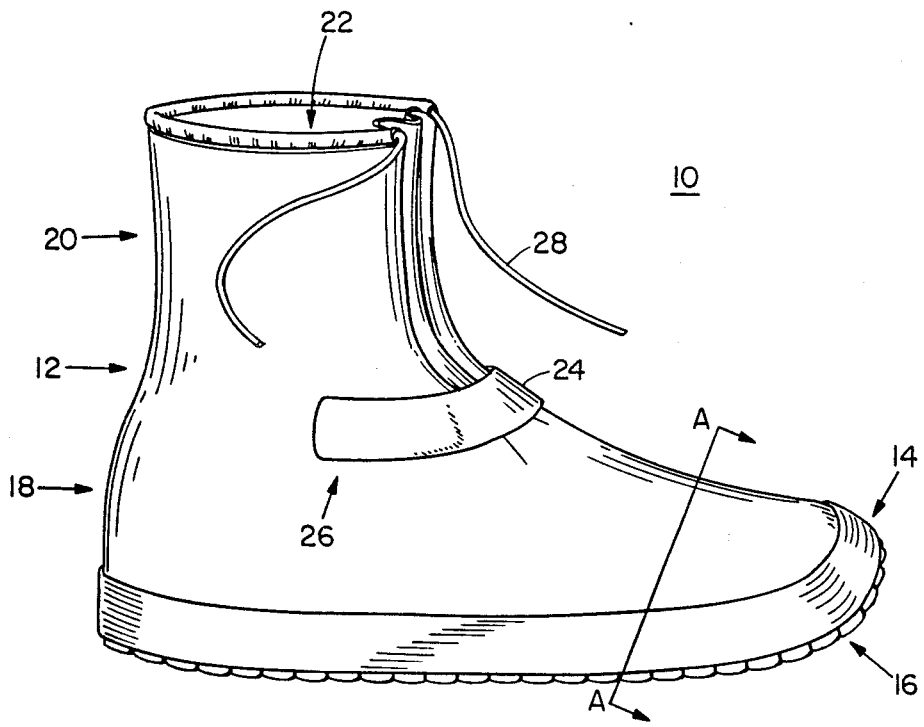
FIG. 1 is a three-dimensional view of a water-resistant boot according to this invention.

Water resistant boots 10, according to this invention, FIG. 1, includes shell 12, retainer 14, and base 16. Shell 12 is constructed of a body portion 18 attached to base 16, an integrally formed sleeve 20.

During use, a user inserts her athletic shoe through opening 22 until the tread of the athletic shoe rests against the upper surface of base 16. It is desirable for the boot to be selected relative to the shoe so that body portion 18 surrounds the shoe as closely as possible and cradles it so that boot 10 does not move relative to the athletic shoe. Slippage between boot 10 and the shoe is further minimized by retainer 14 which is an elastic band of material which completely encircles the lower portion of body portion 18. Retainer 14 provides strong lateral support to enable the user to make quick changes in direction without the interference that slippage would cause.

Boot 10 is further secured to the user by strap 24 having adjustable engagement provided by Velcro pair 26. Drawstring 28 secures the upper portion of sleeve 20 to the ankle to minimize entrance of water through the opening and to further hold sleeve 20 to the ankle. Preferably, sleeve 20 is of sufficient length to cover an ankle sock worn by the user.

Figure 2:
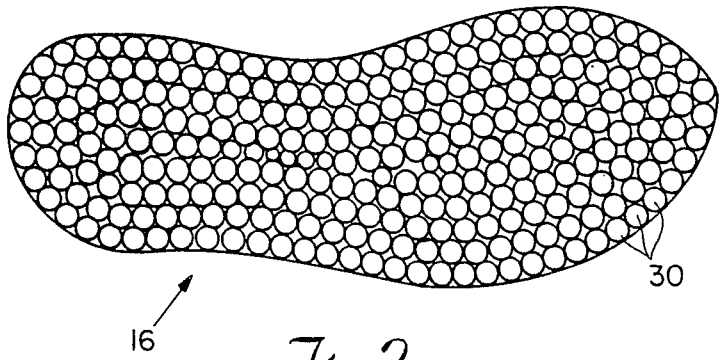
FIG. 2 is a bottom view of the boot of FIG. 1 showing cushion tread being a plurality of collapsible projections.

Base 16 has a number of projections 30 which are shown in FIG. 2 arranged in a pattern which is different than that typically found for athletic footwear. The pattern of elements 30 not only insures traction of the user but also minimizes interference of base 16 with the technology of the athletic shoe.

Figure 3:
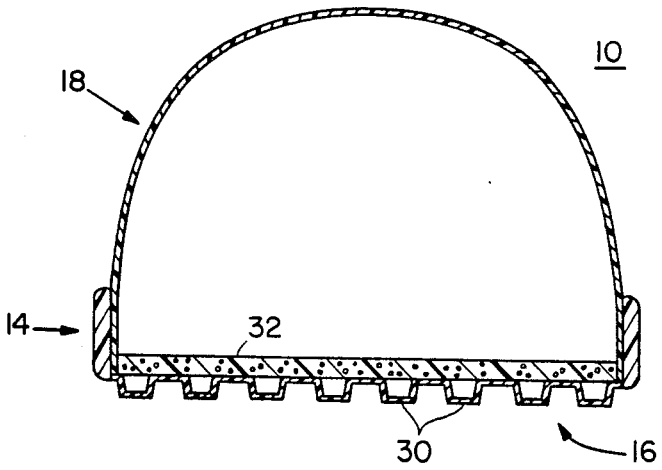
FIG. 3 is a cross-sectional view along lines A—A of FIG. 1.

The construction of deforming elements 30 is shown in FIG. 3 which is a view along lines A—A, FIG. 1. Elements 30 are hollow and are attached to inner sole 32 of base 16. Inner sole 32 is constructed of a sponge-like, flexible rubber compound such as EVA. Ease of entry of the athletic shoe into boot 10 is enhanced by the relatively smooth surface presented by inner sole 32. In another construction, the upper surface of inner sole 32 can be coated with Mylar or other low-friction material.

The hollow construction of elements 30 enables deformation to conform to the tread pattern of the athletic shoe to enhance transfer of the effect of the tread pattern with the ground through elements 30. This feature is particularly desirable for running shoes which have tread patterns biomechanically engineered to minimize shock and vibration while enhancing transfer of energy of a runner to the ground. By comparison, tension across a solid skin, such as is typically present in conventional waterproof coverings, interferes with the transfer of the effect of the tread pattern.

Figure 4:
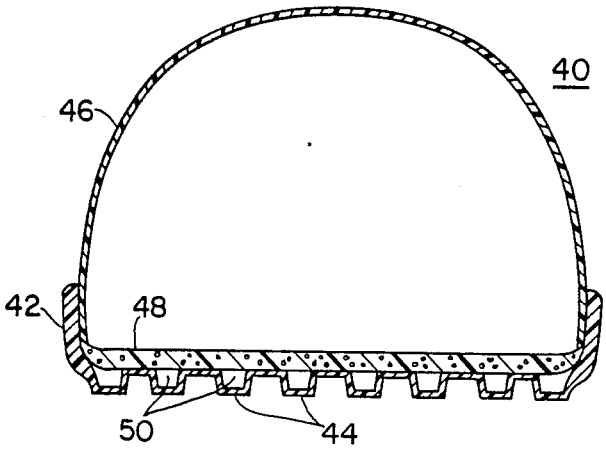
FIG. 4 is a similar cross-sectional view of an alternative boot according to this invention constructed by injection molding.

Boot 40, the toe of which is shown in cross section in FIG. 4, is constructed in a different manner to accommodate formation by soft injection molding. Retainer 42 and elements 44 are formed as an integral piece of durable rubber which is bonded to the material of shell 46. Flexible covering 48 is then placed over the openings 50 of elements 44. In addition to enhancing ease of entry of an athletic shoe into boot 40, covering 48 also cosmetically improves the appearance of the inside of boot 40. Retainer 42 is sufficiently high to completely support the side wall of the athletic shoe.

Figure 5:
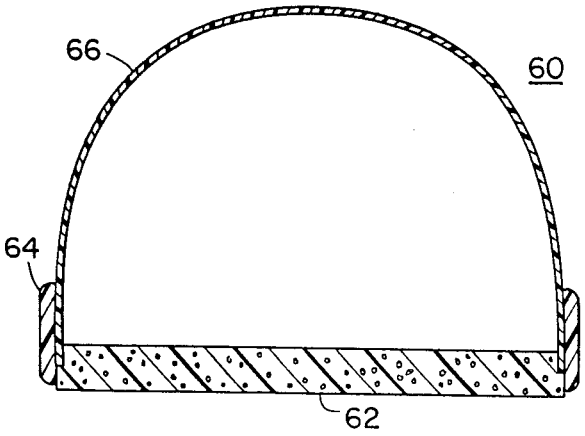
FIG. 5 is a cross-sectional view of yet another boot according to this invention having a solid deforming cushion as its base.

Boot 60, FIG. 5, has a solid base 62 formed of a sponge-like material that deforms when the tread pattern of the athletic shoe is pressed against it. Retainer 64 is formed as a separate band of elastic material which is attached to the outside of shell 66.

In other constructions, the retainer element is a fabric strap with an adjustable fastener such as a Velcro tab or a cinch strap. Such a strap enables the user to tightly secure the boot to her athletic shoe after the shoe is placed within the boot. In yet another construction, when the shell is formed of an elastic material, the retainer can be established as a thickened wall which is integral with the shell itself. When the retainer is a separate element, it can also be disposed inside of the shell.

Although specific features of the invention are shown in some drawings and not others, this is for convenience only as each feature may be combined with any or all of the other features in accordance with the invention.

Other embodiments will occur to those skilled in the art and are with the following claims:

What is claimed is:

1. A water-resistant boot for protecting an athletic shoe, comprising:

a thin, flexible, water-resistant shell having a lower, body portion for closely surrounding and cradling the athletic shoe and an upper, sleeve portion for surrounding the ankle of the user, the sleeve portion having an opening through which the athletic shoe is inserted;

a water-resistant base attached to the body portion for engaging the sole of the athletic shoe, said base including deforming means for conforming to a tread pattern including deformation means for conforming to a tread pattern of the athletic shoe to enhance transfer of the effect of the tread pattern through the base;

retainer means, disposed about the lower periphery of the body portion of the shell, for forcing the shell against the athletic shoe to firmly grip the athletic shoe to minimize slippage between the boot and the shoe; and means for securing the sleeve portion about the ankle of the user.

2. The boot of claim 1 in which the retainer means includes elastic material disposed as a band about the lower periphery of the body portion of the shell.

3. The boot of claim 2 in which the elastic material is disposed on the outer surface of the shell and completely encircles the shell.

4. The boot of claim 1 in which at least the lower portion of the shell includes elastic material and the retainer means is integral with the lower portion.

5. The boot of claim 1 in which the shell is constructed of a water-resistant fabric.

6. The boot of claim 5 in which the water-resistant fabric blocks the passage of water into the shell but allows water vapor to pass outwardly through the shell.

7. The boot of claim 1 in which the shell is constructed of a rubber material.

8. The boot of claim 1 in which the deforming means includes a plurality of collapsible projections extending outwardly from the base.

9. The boot of claim 8 in which the projections are hollow.

10. The boot of claim 8 in which the plurality of projections are arranged in a pattern which is different from the tread pattern.

11. The boot of claim 1 in which the means for securing includes drawstring means proximate the opening of the shell.

12. The boot of claim 1 in which the means for securing further includes strap means for adjustably holding the sleeve portions to the ankle.

13. The boot of claim 1 in which the sleeve completely encloses an ankle sock worn by the user.

14. The boot of claim 1 in which the shell, the base, and the retainer means are flexible to enable the boot to be compactly folded.

15. A water-resistant boot for protecting an athletic shoe, comprising:

thin, flexible, water-resistant shell having a lower, body portion for closely surrounding and cradling the athletic shoe and an upper, sleeve portion for surrounding the ankle of a user, the sleeve portion having an opening through which the athletic shoe is inserted;

a water-resistant base attached to the body portion for engaging the sole of the athletic shoe, the base including deforming means for conforming to a tread pattern of the athletic shoe to enhance transfer of the effect of the tread pattern through the base;

retainer means, formed of an elastic material and disposed about the lower periphery of the body portion of the shell, for forcing the shell against the athletic shoe to firmly grip the athletic shoe to minimize slippage between the boot and the shoe; and means for securing the sleeve portion about the ankle of the user to enhance holding of the sleeve portion to the ankle and to minimize entrance of water through the opening.

16. A water-resistant boot for protecting an athletic shoe inserted in the boot, comprising:

a thin, flexible, water-resistant shell having a lower, body portion for closely surrounding and cradling the athletic shoe and an upper, sleeve portion for surrounding an ankle of a user, the sleeve portion having an opening through which the athletic shoe is inserted;

a water-resistant base attached to the body portion for engaging the sole of the athletic shoe, the base including deforming means for conforming to a tread pattern of the athletic shoe to enhance transfer of the effect of the tread pattern through the base; and means for securing the sleeve portion about the ankle of the user to minimize entrance of water through the opening.

* * * * *